United States Patent [19]

Schmidt et al.

[11] 4,068,694

[45] Jan. 17, 1978

[54] CUTTER SHAFT FOR WOOD MACHINING APPARATUS

[75] Inventors: Arnold Schmidt, Gutenberg; Hans Sybertz, Hargesheim, both of Germany

[73] Assignee: Hombak Maschinenfabrik KG, Bad Kreuznach, Germany

[21] Appl. No.: 701,868

[22] Filed: July 1, 1976

[30] Foreign Application Priority Data

July 14, 1975 Germany ..... 2531345

[51] Int. Cl.[2] ..... B27G 13/00

[52] U.S. Cl. ..... 144/230; 83/698; 144/218; 407/51

[58] Field of Search ..... 29/105 R, 105 A; 144/218, 230; 83/698

[56] References Cited

U.S. PATENT DOCUMENTS

| | | | |
|---|---|---|---|
| 1,713,066 | 5/1929 | Wolf | 144/230 |
| 3,865,164 | 2/1975 | Sybertz | 144/230 |

FOREIGN PATENT DOCUMENTS

| | | | |
|---|---|---|---|
| 2,159,033 | 11/1971 | Germany | 144/230 |
| 1,154,613 | 9/1963 | Germany | 144/230 |
| 174,730 | 4/1953 | Germany | 144/230 |

*Primary Examiner*—Othell M. Simpson
*Assistant Examiner*—W. D. Bray
*Attorney, Agent, or Firm*—Michael J. Striker

[57] ABSTRACT

A cutter shaft for a wood machining apparatus is provided with at least one pocket in which a cutting knife is arranged between a pressure plate and a wear part with the cutting edge of the knife projecting beyond the peripheral surface of the shaft. A wedge located in a cutout of the shaft, intersecting the pocket, is guided in the cutout movable substantially in radial direction of the shaft and engaging with a wedge face, inclined at a predetermined angle with respect to the radial direction, a corresponding face of the pressure plate to press the latter against one side face of the knife and therewith the other side face against said wear part. The aforementioned angle between the two engaging faces is outside the self-locking range and at least 35° and preferably about 42°. The wedge is biased by a spring in radial outward direction and, during rotation of the shaft, also by centrifugal force.

10 Claims, 3 Drawing Figures

CUTTER SHAFT FOR WOOD MACHINING APPARATUS

BACKGROUND OF THE INVENTION

The present invention relates to a cutter shaft for a wood machining apparatus, in which the cutter shaft is provided with a plurality of pockets in each of which a cutting knife is arranged and in which a pressure plate abuts against a side face of each cutting knife which in turn is acted upon by a wedge biased in radial outward direction by a spring and during rotation of the shaft also by centrifugal force.

Such cutter shafts have been built by the Hombak Maschinenfabrik KG, to which the present application is assigned, for about eighteen years. The pressure plate is thereby constructed as knife holder with which the cutting knife is screwed together and adjusted with respect to the desired circle at which the cutting edge of the cutting knife has to be located with respect to the outer periphery of the cutter shaft. The unit comprising the cutting knife and the knife holder is inserted into the pocket of the cutter shaft, after pushing the wedge against the action of the spring in radial inward direction, whereby the knife holder positively engages with an inner edge thereof a holding bar arranged in the pocket and connected by screws or the like to the cutter shaft. Subsequently thereto the wedge is released so that the latter abuts under the pressure of the spring acting thereon, with a wedge face against a corresponding face of the knife holder to press the latter against the cutting knife and the holding bar. The wedge angle in this known construction is about 30°. In this known construction the cutting knife abuts with a side face thereof opposite the side face provided with the cutting edge directly on a face of the pocket provided in the cutter shaft. While during standstill of the shaft the spring abutting against the wedge exerts a pretension, the actual clamping force for holding the cutting knife in a fixed predetermined position during the machining operation is obtained by the centrifugal force acting on the wedge during rotation of the cutter shaft.

This known cutter shaft arrangement has to be reconditioned about once a year due to damage of the outer surface of the cutter shaft at portions thereof which, in the direction of rotation of the shaft, are located rearwardly of the cutting knives. After extended use of the known cutter shaft, the radial outer regions of the cutter shaft body, onto which the cutting knives abut, bulge slightly in outward direction. These damages have been studied for years. According to a generally held opinion this damage was due, on the one hand, to the substantially tangential force component of the wedge and, on the other hand, to the cutting pressure during machining which, especially during engagement of the knives with hard branches, foreign elements, etc. constitutes a high continuously acting stress. The mentioned damage could be reduced, but not completely avoided, by using high-grade steel for the cutter shaft.

The peripheral surface portion of the cutter shaft, located in direction of rotation of the latter, behind the cutting knives are also subjected to considerable wear. This wear leads to groove formation, rearwardly of the above-mentioned upwardly bulging portions, which likewise requires a yearly repair of the shaft.

The present invention is based on the surprising recognition that the above-discussed damage of the cutter shaft is mainly due to the self-locking of the movable wedge. Since rust, dirt and burnt rosin will deposit on the metallic slide faces of pressure plate and wedge, the friction coefficient between these two members will increase considerably and in an uncontrolled manner so that the movable wedge with its wedge angle of 30° will be in the self-locking region. During rotation of the cutter shaft at its operating speed the movable wedge will press with considerable force with one face thereof against a corresponding face of the cutter shaft and with another face thereof against a corresponding face of the knife holder.

During the machining operation the cutter shaft, together with the elements mounted therein, will heat up considerably, due to the high friction between the wood to be machined and the cutter shaft. Due to the thereby resulting expansion, the movable wedge will, under the action of the centrifugal force, slightly move further in radial outward direction. Due to the self-locking of the wedge the latter will retain this position when the cutter shaft cools down again. During shrinking of the body of the cutter shaft extremely high forces will be imparted by the wedge over the knife holder onto the cutting knife, which will finally lead to the described outward bulging of the material of the cutter shaft body rearwardly of the cutting knife.

SUMMARY OF THE INVENTION

It is an object of the present invention to overcome, on the basis of the above-mentioned recognition of the problem, the disadvantages of cutter shafts known in the art.

It is a further object of the present invention to provide a cutter shaft of the aforementioned kind in which damage of the cutter shaft body immediately rearwardly of the cutting knives is reduced and in which such damage can be eliminated without machining the cutter shaft.

With these and other objects in view, which will become apparent as the description proceeds, the present invention relates in a wood machining apparatus to a combination comprising a cutter shaft rotatable in one direction about its axis and provided with at least one pocket extending in longitudinal direction of the shaft, an elongated cutting knife located in this pocket and projecting with a cutting edge thereof beyond the peripheral surface, a pressure plate abutting with one face thereof against one side face of the cutting knife which leads in the direction of rotation of the shaft, a wedge guided in a cutout of the shaft for movement in substantial radial direction of the latter and having a wedge face inclined at an angle to the direction of movement of the wedge and engaging a correspondingly inclined face of the pressure plate opposite the one face thereof, in which the angle is outside the self-locking range between wedge and pressure plate. The arrangement includes further biasing means engaging the wedge for biasing the same in radial outward direction and preferably a wear part arranged in the aforementioned pocket and engaging the other face of the cutting knife substantially over the whole length thereof. The wear part has an outer surface flush with the peripheral surface of the shaft.

In the construction according to the present invention the wedge, which during heating up of the cutter shaft is moved further outwardly, will be pushed inwardly when the cutter shaft cools down again during standstill so that all parts of the claimed combination are only subjected to the forces produced by the spring acting on the wedge and, during operation, also to the centrifugal force acting thereon and such forces can be exactly calculated and controlled. The wear on the peripheral surface of the cutter shaft closely adjacent and rearwardly of the cutting knives can be quickly eliminated by simply replacing wear parts provided at these locations. The arrangement according to the present invention has the decisive advantage that the cutter shaft has not to be taken out for any repairs and that the cost of an additional cutter shaft, which was necessary in the constructions according to the prior art to maintain the wood machining apparatus in operation during reconditioning of the worn cutter shaft, can be saved.

The wedge angle of the wedge is at least 35° and preferably about 42°. In order to obtain an increased machining output, the pressure plate is preferably formed with a recess into which the wedge with its wedge face extends. In this way the angle between the side face of the cutting knife and the radial axis of the wedge can be held relatively small so that a relatively large number of cutting knives may be arranged on the circumference of the shaft.

The wear part is preferably a flat bar which has a longitudinal edge located at the peripheral surface of the cutter shaft, which is provided over its whole length with a substantially triangular projection extending in direction opposite to the direction of rotation of the shaft. The relative small width of the wear part is sufficient, due to the absence of self-locking of the wedge and the thereby resulting reduction of forces created by the same. Due to the triangular extension of the upper end of the wear part, this wear part is enlarged at the peripheral surface of the cutter shaft immediately rearward of the cutting knife, at a location where the greatest wear occurs.

According to a preferred form of the present invention a holding bar is provided in each pocket of the cutter shaft, connected to the body of the latter by screws or the like, and provided with projections engaging corresponding cutouts or grooves in the wear part as well as in the pressure plate, so as to hold these two elements on the holding bar.

The cutting knives may be held between the wear parts and the pressure plates exclusively by the pressure of the wedge, whereby the pressure plate is held by means of a pressure spring securely on the holding bar. In this construction the adjustment of the radial position of the cutting knives can be carried out as explained in the U.S. Pat. No. 3,931,681.

The cutting knife can also be constructed as a discardable knife, which with its radial inner edge, which may also be constructed as a second cutting edge, abuts against a surface of a member which is spring biased in radial outward direction to thereby yieldably hold the cutting edge of the knife, when the pressure plate is not loaded, slightly beyond the circle at which the outer edge of the knife has to move during the cutting operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
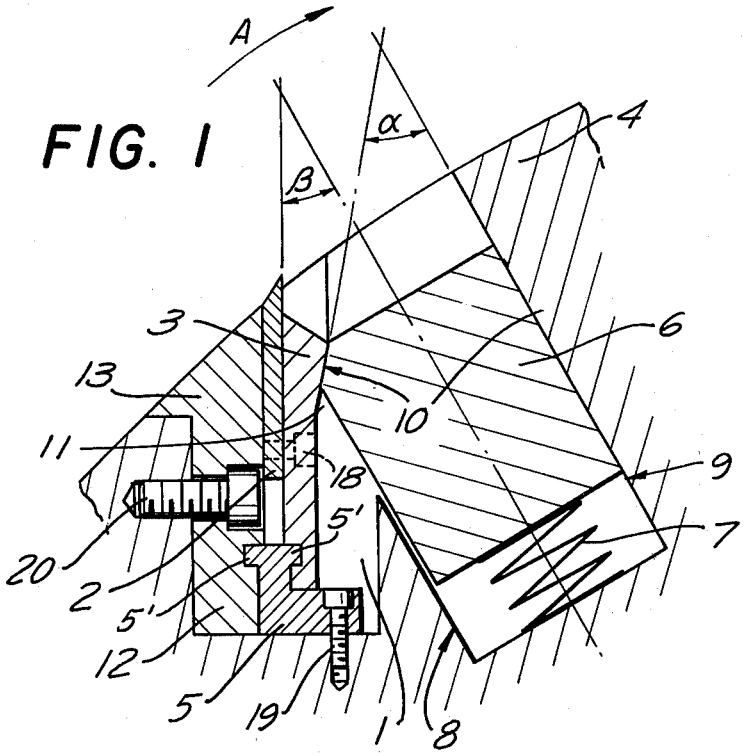
FIG. 1 is a partial cross-section through a cutter shaft and illustrating a cutting knife which can be reground and which is positively held in its working position.

In all three Figures of the drawing the cutter shaft, only partially shown in these three Figures is supposed to rotate in clockwise direction as indicated by the arrow A in FIG. 1.

The cutter shaft 4, only partially shown in FIG. 1, is provided with a plurality of elongated pockets 1 extending in axial direction of the shaft 4 and uniformly spaced from each other from the peripheral surface of the cutting shaft into the body of the latter. Only one of these pockets is shown in FIG. 1. A cutting knife 2, which can be reground, is arranged in the pocket 1, abutting with its leading side face against a knife holder or pressure plate 3 and connected to the latter by at least one, or a plurality of screws 18. A holding bar 5 engaging the bottom face of the pocket 1 is connected to the body of the cutter shaft 4 by a plurality of screws 19, only one of which is shown in FIG. 1, and the holding bar 5 is provided with an upwardly extending portion having laterally extending projections 5', one of which is engaged in a corresponding groove of the knife holder 3. The upper portion of the knife holder 3 is engaged by the wedge face 10 of a wedge 6 guided for movement in radial direction of the cutter shaft 4 between parallel guide faces 8 and 9 of a cutout in the cutter shaft and biased in radial outward direction by a compression spring 7, sandwiched between the bottom face of the wedge 6 and a corresponding face of the aforementioned cutout. The wedge face 10 engages a corresponding slide face in a depression 11 formed in the knife holder 3. The wedge angle $\alpha$ of the wedge 6, that is the angle included between the wedge face 10 and the direction of the face 9 guiding the wedge for movement in radial direction of the cutter shaft, is at least 35° and preferably about 41° so that no self-locking of the wedge will occur. The trailing side face of the cutting knife 2 abuts over the whole length thereof against a wear part 12 located in the pocket 1 rearwardly, as considered in the direction of rotation of the cutter shaft 4, of the cutting knife 2. The wear part 12 is in form of a flat bar having at its outer edge, which is flush with the peripheral surface of the cutter shaft 4, a substantially triangular projection 13 extending opposite to the direction of rotation of the cutter shaft. Adjacent its radially inner end the wear part 12 is provided with a longitudinal groove in which the other projection 5' of the holding bar is engaged. The wear part 12 abuts with its trailing side face against a corresponding face of the pocket 1 and one of a plurality of screws 20 secure the wear part to the body of the cutter shaft 4.

In order to be able to mount as many cutting knives as possible on the circumference of the cutter shaft 4, the angle $\beta$ between the leading side face of the cutting knife 2 and the axis of the wedge 6 has to be held as small as possible, in which case it is advantageous, in order to obtain a wedge angle $\alpha$ as large as possible, to abut the wedge face 10 of the wedge 6 against a correspondingly formed slide face in a cutout 11 of the knife holder 3.

Figure 2:
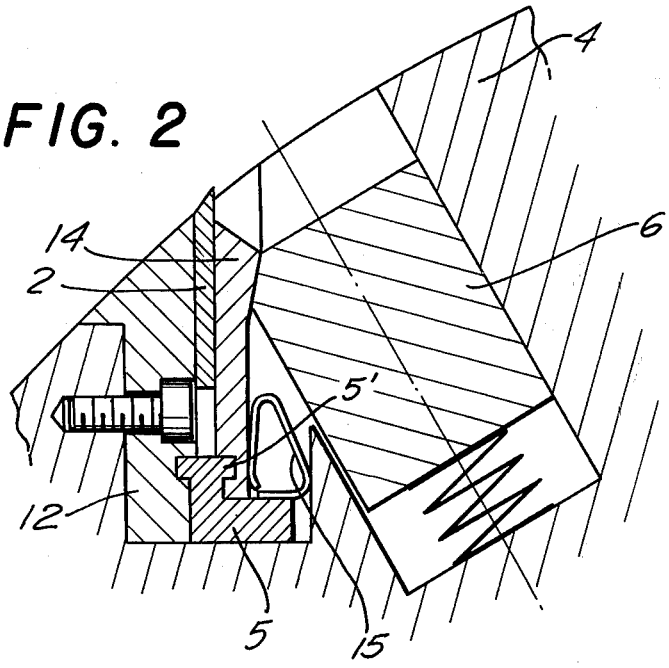
FIG. 2 is a partial cross-section similar to FIG. 1 in which the cutting knife is held solely by the pressure exerted by a wedge on a pressure plate engaging a side face of the knife.
Figure 3:
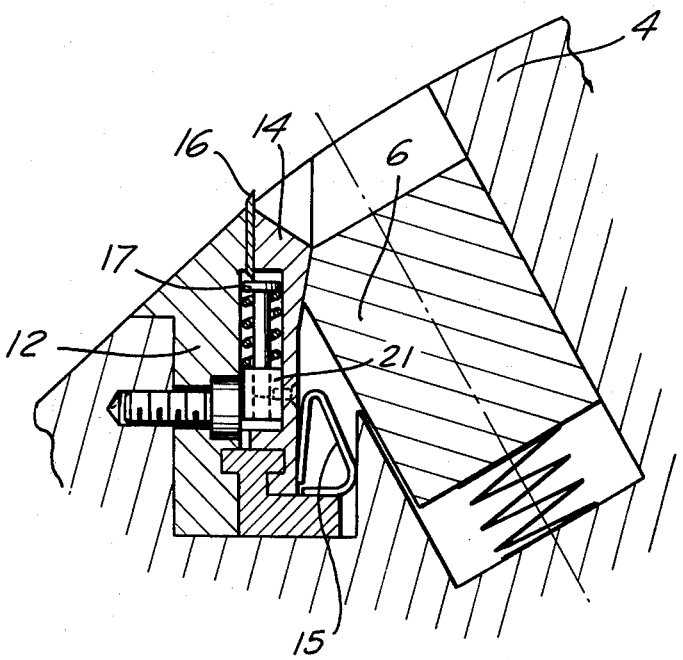
FIG. 3 is a partial cross-section similar to FIG. 1 showing a discardable cutting knife, which is held by the pressure exerted by a wedge engaging a pressure plate, which in turn engages a side face of the knife.

Whereas in FIG. 1 the pressure plate 3, which receives the pressure from the wedge 6, is connected by screws to the cutting knife 2, in the embodiment shown in FIGS. 2 and 3 the pressure plate 14 is not connected by any connecting element to the cutting knife 2. In the embodiment shown in FIG. 2 the pressure plate 14 is positively held against displacement in outward direction by a pressure spring 15, pressing a groove at the lower end of the pressure plate 14 into a corresponding lateral projection 5' of the holding bar 5, whereas the cutting knife 2 is held between the wear part 12 and the pressure plate 14 solely by the pressure imparted by the wedge 6 onto the pressure plate 14.

While the cutting knife 2 shown in FIGS. 1 and 2 can be reground, FIG. 3 discloses an embodiment in which the cutting knife 16 is a disposable cutting knife, preferably provided at opposite edges with cutting edges, so that if one of the cutting edges is worn the cutting knife 16 may be reversed and the opposite cutting edge be used, and after the latter is likewise worn the cutting knife 16 is discarded. The disposable cutting knife 16, shown in FIG. 3, is considerably shorter and thinner than the cutting knives 2 shown in FIGS. 1 and 2. The cutting knife 16 is held between the wear part 12 and the pressure plate 14 solely by the pressure imparted to the pressure plate by the wedge 6. The bottom edge of the disposable cutting knife 16, which as mentioned before, may also be constructed as a cutting edge, is engaged in this modification by the top face of an enlarged portion of a pin-shaped member 17, the stem of which is guided for movement in longitudinal direction in a guide member 21, connected by screws or the like to the pressure plate 14. The member 17 is biased by a coil compression spring sandwiched between the bottom face of the enlarged portion of the member 17 and the upper face of the guide member 21 in outward direction to hold the outer edge of the cutting knife 16, when the pressure plate 14 is not loaded by the wedge 6, in a position beyond the desired position to which the outer edge of the cutting knife has to be adjusted during operation.

It will be understood that each of the elements described above, or two or more together, may also find a useful application in other types of cutter shafts for wood machining apparatus differing from the types described above.

While the invention has been illustrated and described as embodied in a cutter shaft for a wood machining apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a wood machining apparatus, a combination comprising an elongated cutter element having an axis and being rotatable in one direction about said axis and provided with at least one pocket extending in the longitudinal direction of said element from the peripheral surface of the latter into the same; an elongated cutting knife located in said pocket and projecting with a cutting edge thereof beyond said peripheral surface, said cutting knife having a pair of substantially parallel side faces, one of said faces leading in the direction of rotation of said element; a pressure plate abutting with one face thereof against said one side face of said knife; a wedge guided in a cutout of said element which is located ahead of said cutting knife as considered in the direction of rotation of said element, for movement in substantially radial direction of the element and having a wedge face inclined at an angle to the direction of movement of the wedge and engaging a correspondingly inclined face of the pressure plate opposite said one face thereof, said angle being within a range that is outside the angular range at which self-locking occurs between said wedge and said pressure plate; biasing means engaging said wedge for biasing the same in radial outward direction; and a part subject to wear located in said pocket and engaging the other side face of said cutting knife substantially over the whole length thereof, said part having an outer surface flush with said peripheral surface of said element.

2. A combination as defined in claim 1, wherein said angle is at least 35°.

3. A combination as defined in claim 1, wherein said angle is about 42°.

4. A combination as defined in claim 1, wherein said pressure plate is provided with a recess forming said corresponding face engaged by said wedge face of said wedge.

5. A combination as defined in claim 1, wherein said part is constituted by a bar having a triangular projection extending along the whole length of said bar and projecting in a direction opposite to said one direction, said triangular projection having an outer curved surface flush with said peripheral surface of said cutter element.

6. In a wood machining apparatus, a combination comprising an elongated cutter element having an axis and being rotatable in one direction about said axis and provided with at least one pocket extending in the longitudinal direction of said element from the peripheral surface of the latter into the same and having a bottom face; an elongated cutting knife located in said pocket and projecting with a cutting edge thereof beyond said peripheral surface, said cutting knife having a pair of substantially parallel side faces, one of said side faces leading in the direction of rotation of said element; a pressure plate abutting with one face thereof against said one side face of said knife; a wedge guided in a cutout of said element for movement in substantial radial direction of the latter and having a wedge face inclined at an angle to the direction of movement of the wedge and engaging a correspondingly inclined face of the pressure plate opposite said one face thereof, said angle being within a range that is outside the angular range at which self-locking occurs between said wedge and said pressure plate; biasing means engaging said wedge for biasing the same in radial outward direction; a part subject to wear located in said pocket and engaging the other side face of said cutting knife substantially over the whole length thereof, said part having an outer surface flush with said peripheral surface of said element, said one face of said pressure plate and a face of said wear part opposite said one face of the pressure plate both being provided with grooves extending in longitudinal direction of said shaft; a holding bar abutting against said bottom face of said pocket and having a pair of opposite lateral projections respectively located in said grooves; and means connecting said holding bar to said shaft.

7. A combination as defined in claim 6, and including at least one screw connecting said cutting knife to said pressure plate.

8. A combination as defined in claim 6, wherein said cutting knife is held between said pressure plate and said part exclusively by the pressure exerted by said wedge onto said pressure plate.

9. A combination as defined in claim 8, and including a pressure spring in said pocket for pressing the groove in said pressure plate into the corresponding projection of said holding bar.

10. A combination as defined by claim 6, wherein said knife is constituted by a disposable knife having a radial inner edge and including resilient means engaging said inner edge of said cutting knife for holding the outer edge thereof, when said pressure plate is relieved of pressure, slightly beyond the desired working position thereof.

* * * * *